US005320048A

United States Patent [19]

Feiner

[11] Patent Number: 5,320,048

[45] Date of Patent: Jun. 14, 1994

[54] PANEL STRUCTURES FORMED BY EXTRUSION

[76] Inventor: Gideon Feiner, 42 Hashoftim Street, Tel Aviv, Israel

[21] Appl. No.: 674,013

[22] Filed: Mar. 25, 1991

[30] Foreign Application Priority Data

Apr. 2, 1990 [IL] Israel ..... 93976

[51] Int. Cl.[5] ..... B65D 19/00

[52] U.S. Cl. ..... 108/51.1; 108/902; 108/51.3

[58] Field of Search ..... 108/901, 902, 51.1, 108/51.3, 55.1, 55.3, 55.5, 56.1, 56.3

[56] References Cited

U.S. PATENT DOCUMENTS

| | | | |
|---|---|---|---|
| 2,798,685 | 7/1957 | Mooney . | |
| 3,168,879 | 2/1965 | Clark, Jr. . | |
| 3,187,691 | 6/1965 | Leitzel . | |
| 3,199,469 | 8/1965 | Sullivan . | |
| 3,247,810 | 4/1966 | Sepe et al. . | |
| 3,277,849 | 10/1966 | Talbot . | |
| 3,347,185 | 10/1967 | Colas | 108/55.5 X |
| 3,405,666 | 10/1968 | Miller | 108/901 X |
| 3,567,068 | 3/1971 | Carfizzi . | |
| 3,581,681 | 6/1971 | Newton . | |
| 3,691,964 | 9/1972 | Larson et al. . | |
| 3,759,193 | 9/1973 | Branch | 108/901 X |
| 3,762,342 | 10/1973 | Lawlor . | |
| 3,795,206 | 3/1974 | Utz . | |
| 3,824,933 | 7/1974 | Lind . | |
| 3,910,202 | 10/1975 | Skahan . | |
| 4,029,023 | 6/1977 | Rosewicz et al. . | |
| 4,145,976 | 3/1979 | Svirklys . | |
| 4,240,360 | 12/1980 | Sanders et al. | 108/51.1 X |
| 4,347,794 | 9/1982 | Nordstrom | 108/55.1 X |
| 4,445,614 | 5/1984 | Mitsumori et al. . | |
| 4,715,294 | 12/1987 | Depen | 108/51.1 |
| 4,838,176 | 6/1989 | Bowser et al. . | |
| 4,966,083 | 10/1990 | Cerugeira . | |
| 4,976,353 | 12/1990 | Halliday . | |

FOREIGN PATENT DOCUMENTS

| | | | |
|---|---|---|---|
| 2224137 | 11/1973 | Fed. Rep. of Germany | 108/56.1 |
| 99987 | 7/1961 | Netherlands | 108/56.1 |

*Primary Examiner*—Jose V. Chen
*Attorney, Agent, or Firm*—Benjamin J. Barish

[57] ABSTRACT

A panel includes a planar face layer formed by continuous extrusion, and a plurality of ribs extending longitudinally of the face layer and also formed by continuous extrusion. The ribs are hollow and have a height at least five times the thickness of the planar face layer. The ribs rigidify the panels in the transverse direction, and end caps are applied transversely to rigidify it in the longitudinal direction.

13 Claims, 3 Drawing Sheets

FIG 1
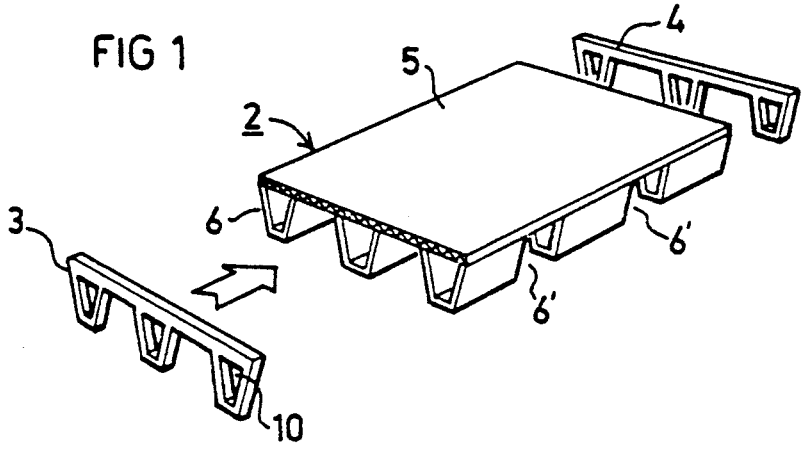
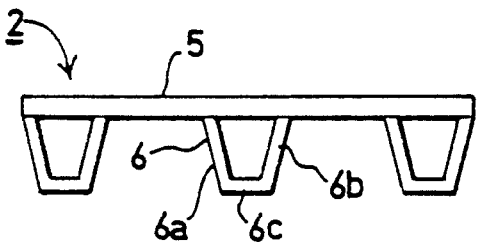
FIG 2
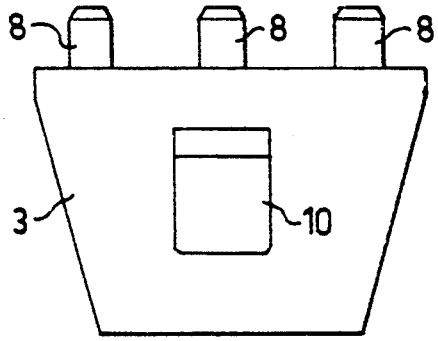
FIG 3
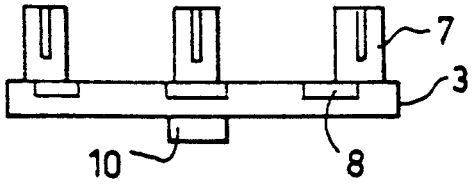
FIG 4
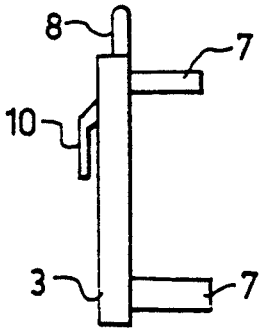
FIG 5

FIG 6
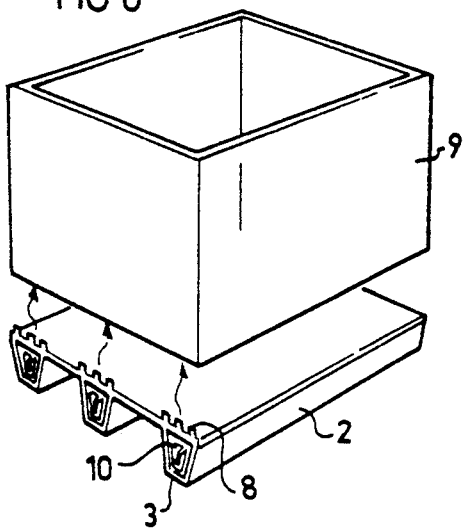
FIG 7
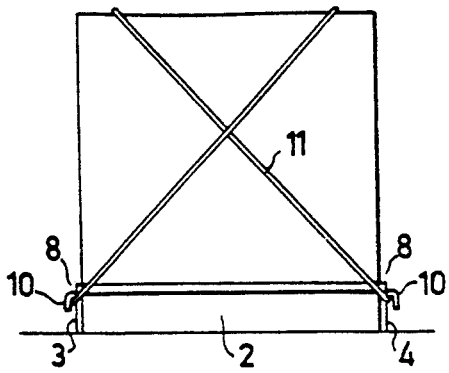
FIG 8
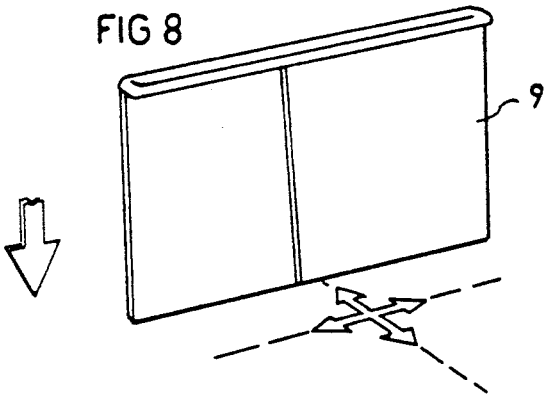
FIG 9
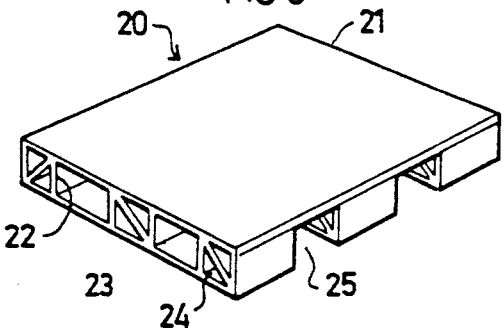
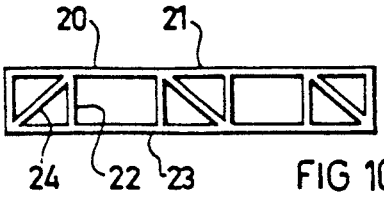
FIG 10

FIG 11
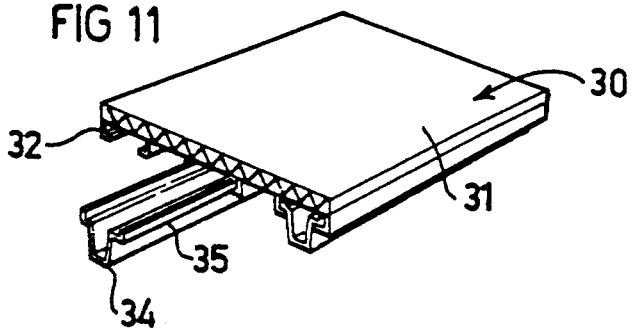
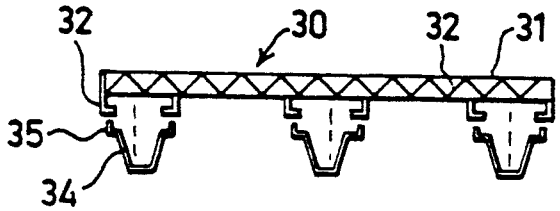
FIG 12
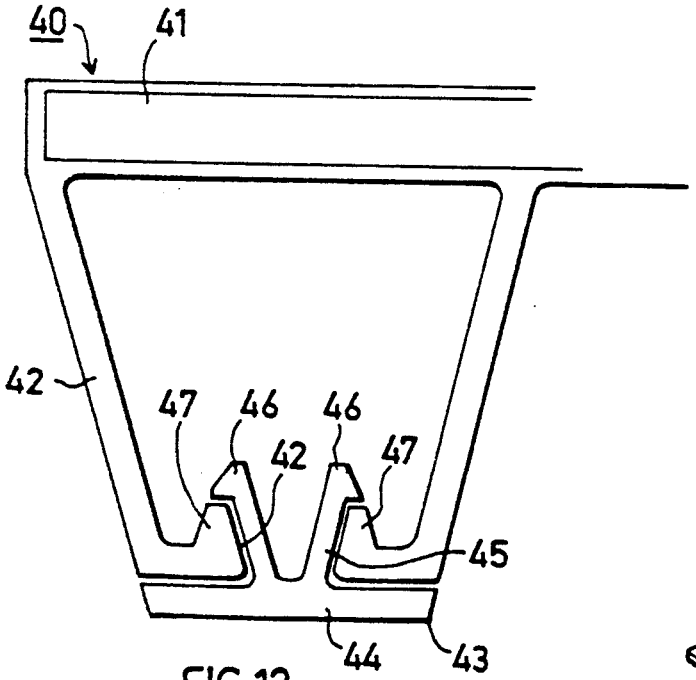
FIG 13
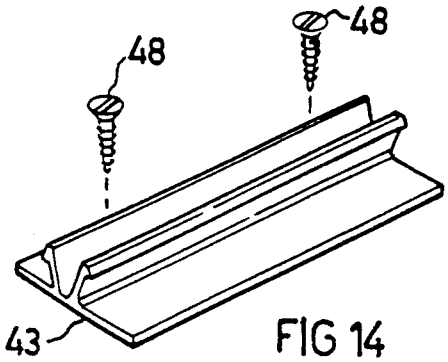
FIG 14

PANEL STRUCTURES FORMED BY EXTRUSION

FIELD AND BACKGROUND OF THE INVENTION

The present invention relates to panel structures and particularly to such structures formed by extrusion.

OBJECTS AND BRIEF SUMMARY OF THE INVENTION

An object of the present invention is to provide panel structures, particularly plastic panel structures, which may be produced in volume and at low cost by extrusion and which are usable as pallets and as bottoms for containers, as well as a number of other different applications.

According to the present invention, there is provided a panel structure including a planar face layer formed by continuous extrusion, and a plurality of ribs extending longitudinally of the face layer and also formed therewith by continuous extrusion, the ribs being hollow and having a height at least five times the thickness of the planar face layer.

The panel structure further includes a pair of end caps applied transversely across ends of the panel structure. The end caps include a plurality of extensions spaced along the length of the respective end cap so as to be alignable with the hollow ribs of the planar face layer. The extensions are of the configuration to be frictionally receivable within the hollow ribs at the opposite ends of the pallet. The end caps are made of a relatively strong plastic material, such that the longitudinally-extending hollow ribs rigidify the pallet in the transverse dimension, and the end caps rigidify the pallet in the longitudinal dimension.

In such a construction, the longitudinally-extending ribs rigidify the panel against transverse bending; and the end caps, which may be of a relatively strong material made by injection moulding, rigidify the panel structure against transverse bending, thereby making such a panel structure especially suitable for use as a pallet for supporting a load, such as a plurality of stacked containers.

According to still further features in some of the described preferred embodiments, the end caps include connections for attaching them to the ends of the face layer and ribs. The end caps further include abutments on their faces adjacent the planar face layer of the panel structure engageable with the outer faces of a carton when the panel is used as its bottom wall, or the outer faces of containers when the panel is used as a pallet for stacking containers thereon.

According to additional features in the described preferred embodiments, the end caps further include hooks on their outer side faces for receiving tying cords for tying the carton side walls to the bottom wall, or a stack of the containers to the pallet.

A still further embodiment of the invention is described wherein the ribs integrally formed by extrusion with the planar face layer include slots for slidably receiving channel sections formed with complementary ribs along their length. Such a construction is particularly useful in making side walls, ceilings or floors, wherein the channel sections slidably receive planar face layers constituting sections of a side wall, ceiling or floor.

Panel structures constructed in accordance with the forgoing features may be used for many different applications, particularly as bottoms of cartons, as pallets for carrying stacks of containers and other loads, and as sections of side walls, ceilings and floors, and may be manufactured by extrusion, thereby enbling them to be produced in volume and at low cost.

Further features and advantages of the invention will be apparent from the description below.

BRIEF DESCRIPTION OF THE DRAWINGS

The invention is herein described, by way of example only, with reference to the accompanying drawings, wherein:

FIG. 1 is three-dimensional view illustrating one form of panel structure constructed in accordance with the present invention, which panel structure is constituted of a continuous extrusion and a pair of end caps attached at its opposite ends;

FIG. 2 is an in view of the panel structure of FIG. 1 without the end cap;

FIGS. 3, 4 and 5 are end, top and side views, respectively, of one the end caps of FIG. 1;

FIG. 6 is a perspective view illustrating a panel structure made in accordance with FIGS. 1-5 used as a pallet for supporting a load of one or more containers;

FIG. 7 is a side view illustrating the pallet and load of FIG. 6;

FIG. 8 illustrates the side wall of the container supported on the pallet of FIGS. 6 and 7 when the side walls are in their collapsed condition;

FIG. 9 is a perspective view illustrating another pallet construction in accordance with the present invention;

FIG. 10 is an end view of the pallet of FIG. 9;

FIG. 11 illustrates another pallet construction in accordance with the invention;

FIG. 12 is an exploded end view of the pallet of FIG. 11;

FIG. 13 illustrates another panel structure constructed in accordance with the present invention particularly useful for mounting side wall, ceiling and floor panels; and FIG. 14 is a three-dimensional view illustrating a section of the panel of FIG. 13.

DESCRIPTION OF PREFERRED EMBODIMENTS

The panel structure illustrated in FIG. 1 is particularly useful as a pallet for supporting a load, such as a plurality of containers to be stacked thereon. FIGS. 6 and 7 illustrate the pallet of FIG. 1 used as the bottom of a single container having collapsible side walls, which side walls may be removed when the pallet is not being used in order to save space, e.g. for storage or empty-return.

The pallet illustrated in FIG. 1 comprises a panel, generally designated 2, formed by extrusion, and a pair of end caps 3, 4 attached to the opposite ends of the panel and preferably made by injection moulding. The extruded panel 2 comprises a planar face layer 5 and a plurality of ribs 6 extending longitudinally of the face layer and integrally formed therewith by continuous extrusion. Ribs 6 are hollow, having side walls **6*a*, 6*b* which converge towards each other and terminate in flat end walls 6*c* at the outer faces the ribs opposite to the planar face layer 5**.

Ribs 6 have a height which is substantially larger than, preferably at least five times larger than, the thickness of the planar face layer 5. For example when the pallet illustrated in FIG. 1 is used in the application illustrated in FIGS. 6 and 7, face layer 5 may have a thickness of 1–2 mm, and the ribs 6 may have a height of 10–20 mm. In other applications where the pallet is used for supporting larger loads, the face layer 5 may have a thickness of about 10 mm whereupon the ribs 6 should have a height of at least 50 mm.

The end caps 3, 4 are preferably made of relatively hard plastic material formed by injection moulding. The end caps 3, 4 are applied transversely across the opposite ends of the panel 2 and conform to the end configuration of the face layer 5 and ribs 6 of the panel. The caps include inwardly-extending legs or extensions 7 receivable within the hollow ribs 6 at the opposite ends of the panel engageable with the inner surfaces of the face layer 5 of the panel 2 for frictionaly-fitting the end caps to the panel. If desired, the end caps may also be adhesively joined to the ends of the panel 2, while in the illustrated examples the end caps abut the end faces of the panel, they may overlap them.

It will be seen that the longitudinally-extending ribs 6 rigidify the panel 2 in the transverse dimension of the panel, whereas the end caps, 4 rigidify the panel in the longitudinal dimension. Where relatively high strength is required in the transverse dimension, the ribs 6 may extend continuously for the complete length of the planar face layer 5, as shown in the panel structure illustrated in FIG. 6 and 7. However, where the planar face layer 5 is relatively thick so that it, together with the end caps 3, 4, provides sufficient transverse rigidity, the ribs 6 may be interupted at spaced intervals along their length, as shown at 6' in FIG. 1. In the latter construction, the ribs also serve the function of feet for spacing the face panel 5, and the load supported thereon, above the ground, while at the same time providing recesses for receiving the splines of fork-lift trucks used in transporting the pallet and its load from one location to another. The interruptions 6' may be formed by cutting away portions of the ribs 6 after extrusion.

As shown particularly in FIG. 3–5, the end caps 3, 4 are intergrally formed with a plurality of spaced posts 8 projecting from the larger-dimension face of the end caps, in addition to the legs 7 projecting inwardly of the end caps. Posts 8 serve as abutments engageable with the inner face of the container or containers carried by the pallet.

FIGS. 6 and 7 illustrate the pallet 2 as being used as the bottom wall for a single container having four side walls 9 hingedly connected together so as to be opened to their operative condition as illustrated in FIGS. 6 and 7 for carrying a load, or to be folded to their collapse condition as illustrated in FIG. 8 for storage or empty-return. When the side walls 9 are in their open operative condition (FIGS. 6, 7), the posts 8 serve as abutments engaging the inner faces of the opposite side walls to secure them in position. The end caps 3, 4 are additionaly formed with tongues 10 which serve as hooks for receiving cords 11 for securing the side walls 9, and the load within them, to the pallet 2 as shown in FIG. 7.

It will thus be seen that the panel structure illustrated in FIGS. 1–8 may be produced in volume and at low cost. It will also be seen that the illustrated panel structure may be advantageously used as a pallet for carrying loads since it provides both longitudinal and transverse rigidity, and at the same time permits disassembly to a compact form for storage or empty-return.

In the panel structure illustrated in FIG. 1, the planar facing layer 5 may be a solid layer; alternatively, it may be of other constructions that can be continuously extruded with the ribs 6, such as a twin-wall construction including two planar faces spaced apart by a plurality of longitudinally-extending ribs.

FIGS. 9 and 10 illustrate another panel construction in accordance with the present invention, also particularly useful as a pallet. The panel illustrated in FIGS. 9 and 10 also includes a planar face layer 21 and a plurality of longitudinally-extending ribs 22 spaced from each other transversely of the face layer 21. In this case, however, the ribs 22 are of rectangular configuration and their outer faces are continuously joined by a second planar face layer 23, defining the second or opposite face of the panel structure. In the construction illustrated in FIGS. 9 and 10, at least some of the hollow ribs are formed with diagonal reinforcing walls 24 also extending longitudinally of the panel structure. In the illustrated example, the diagonal walls 24 occupy alternate hollow ribs; also, the ribs are interupted at spaced intervals, as shown at 25, along their length to define supporting feet when the panel structure is used as a pallet.

The panel structure illustrated in FIGS. 9 and 10 may also include the end caps (3, 4, FIG. 1) to impart longitudinal rigidity to the panel structure. This panel structure may also be produced by continuous extrusion and thereby provides the many advantages described above with respect to the panel illustrated in FIG. 1.

FIGS. 11 and 12 illustrate a further panel structure, generally designated 30, constructed in accordance with the present invention. Panel structure 30 illustrated in FIGS. 11 and 12 includes a planar face layer 31 and a plurality of pairs of flanges 32 extending longitudinally of the face layer and integrally formed therewith by continuous extrusion. The flanges 32 of each pair face each other for slidably receiving channel members 34 integrally formed with complementary flanges 35 along their length. Thus, panel structure 30, including its planar face layer 31, and flanges 32, may be continuously formed by one extrusion, and the channel members 34 including the flanges 35 may be formed by another extrusion. When the channel members are thus attached, they serve as the reinforcing ribs, thereby enabling the panel structure to be used as a pallet and providing the many advantages described above with respect to FIG. 1. The pallet illustrated in FIGS. 11 and 12 may of course also include the end caps (3, 4, FIG. 1) to provide longitudinal rigidity to the panel particularly when used as pallet.

FIGS. 13 and 14 illustrate a further panel structure, generally designated 40, constructed in accordance with the invention to include a planar face layer 41 and a plurality of ribs 42 extending longitudinally of the face layer and integrally formed therewith by continuous extrusion. In this case, the ribs 42 converge toward each other outwardly from the panel but are interrupted at their outer ends to form slots 42' for receiving channel sections 43. The channel sections 43 are also continuous extrusions. Each is formed with a planar face layer 44 and diverging ribs 45, terminating in outwardly-directed shoulder 46 engageable with shoulders 47 formed in extrusion 40 on each side of its slots 42'.

Ribs 45 of channel sections 43 are flexible and are formed with tapered outer faces, such that when they are aligned with the slots 42' in ribs 42 of extrusion 40 and pressed towards the planar face layer 41 of extrusion 40, the ribs 45 are flexed inwardly and then snap into place behind shoulders 47 of ribs 42 to firmly lock the channel sections in place.

The construction illustrated in FIGS. 13 and 14 may also be used, in addition to pallets, also for mounting side walls, ceilings (e.g., acoustical ceilings), and floors (e.g. floating floors), e.g., by fasteners 48 fixing channel sections 13 to the side wall, ceiling or floor, and then snapping extrusion 40 thereover as described above.

While the invention has been described with respect to several preferred embodiments, it will be appreciated that these are set forth merely for purposes of illustration. Thus, the ribs may be filled with plastic foam, e.g. polyurethane, for increased rigidity, or may be reinforced with metal bars. Many other variations, modifications and applications of the invention may be made.

What is claimed is:

1. A panel structure including a planar face layer formed by continuous extrusion and having the same cross-section for its complete length; a plurality of ribs integrally formed with, and extending longitudinally of the face layer and also formed by continuous extrusion, said ribs being hollow and having a height at least five times the thickness of the planar face layer; and a pair of end caps applied transversely across the opposite ends of the panel structure; said end caps including a plurality of extensions spaced along the length of the respective end cap aligned with said hollow ribs of the planar face layer and of the configuration frictionally received within the hollow ribs at the opposite ends of the pallet, and being made of relatively strong plastic material, such that the longitudinally-extending hollow ribs rigidify the pallet in the transverse dimension, and the end caps rigidify the pallet in the longitudinal dimension.

2. The panel structure according to claim 1, wherein said hollow ribs have side walls converging towards each other and terminating in a flat end wall at the outer face of the ribs.

3. The panel structure according to claim 2, wherein said end cap extensions are fixed by adhesive within the ends of the hollow ribs.

4. The panel structure according to claim 2, wherein said end caps include abutments on their faces adjacent the planar face layer of the panel structure engageable with the outer faces of a carton or containers when the panel structure is used as a bottom wall of a carton, or as a pallet for stacking containers thereon.

5. The panel structure according to claim 4, wherein said end caps further include hooks on their outer side faces for receiving tying cords for tying the carton side walls to the bottom wall, or the containers to the pallet.

6. The panel structure according to claim 1, wherein said ribs are continuous and extend longitudinally of the panel structure.

7. The panel structure according to claim 1, wherein said ribs are interrupted at spaced intervals longitudinally of the panel structure to define feet for spacing the face layer above the ground while at the same time providing recesses for receiving the splines of fork-lift trucks used in transporting the pallet and its load from one location to another.

8. The panel structure according to claim 1, wherein said ribs are continuously joined to each other transversely of the panel structure to define a second face layer at the opposite face of the panel structure.

9. The panel structure according to claim 1, wherein at least some of said hollow ribs are formed with diagonal reinforcing walls also extending longitudinally of the panel structure.

10. The panel structure according to claim 1, wherein said ribs are integrally formed with said planar face layer.

11. The panel structure according to claim 1, wherein said planar face layer is formed with flanges, and said ribs are in the form of channel members slidably received within said flanges.

12. The panel structure according to claim 1, wherein said planar face layer includes ribs formed with slots for slidably receiving channel sections formed with outwardly-diverging ribs receivable in the slots of the planar face layer.

13. The panel structure according to claim 12, wherein said outwardly-diverging ribs in said channel sections terminate in interlocking elements at their outer faces which interlock with the portions of said ribs in said planar face layer on opposite sides of said slots.

* * * * *